US006391842B1

(12) United States Patent
Uno et al.

(10) Patent No.: US 6,391,842 B1
(45) Date of Patent: May 21, 2002

(54) CLEAR LIQUID DETERGENT CONTAINING LIQUID SODIUM SILICATE AND SURFACTANTS IN WATER

(75) Inventors: Minoru Uno; Tsutomu Uno; Hisashi Uno, all of Ampachi-gun (JP)

(73) Assignee: Uno Shoyu Co., Ltd. (JP)

( * ) Notice: Subject to any disclaimer, the term of this patent is extended or adjusted under 35 U.S.C. 154(b) by 0 days.

(21) Appl. No.: 09/367,738

(22) PCT Filed: Dec. 17, 1998

(86) PCT No.: PCT/JP98/05724

§ 371 Date: Aug. 18, 1999

§ 102(e) Date: Aug. 18, 1999

(87) PCT Pub. No.: WO99/31210

PCT Pub. Date: Jun. 24, 1999

(30) Foreign Application Priority Data

Dec. 18, 1997 (JP) ..... 9-349459

(51) Int. Cl.[7] ..... C11D 17/00

(52) U.S. Cl. ..... 510/426; 510/421; 510/424; 510/428; 510/477; 510/508; 510/511

(58) Field of Search ..... 510/421, 422, 510/424, 426, 428, 477, 511, 508

(56) References Cited

U.S. PATENT DOCUMENTS 5,759,980 A * 6/1998 Russo et al. ..... 510/241
5,858,951 A 1/1999 Ip et al.
5,863,878 A * 1/1999 Carr et al. ..... 510/352

FOREIGN PATENT DOCUMENTS

| | | |
|---|---|---|
| AU | 25931/84 | 9/1984 |
| JP | 48-89209 A2 | 11/1973 |
| JP | 52-82908 A2 | 7/1977 |
| JP | 57-16098 | 1/1982 |
| JP | 59-182897 | 10/1984 |
| JP | 7-506608 T2 | 7/1995 |
| JP | 8-3594 | 1/1996 |
| JP | 8-218095 | 8/1996 |
| JP | 8-283972 A2 | 10/1996 |

OTHER PUBLICATIONS

Korean Office Action dated Oct. 29, 2001, in connection with Korean Patent Application No. 10–1999–7007018.

Database WPI, XP002156465, May 5, 1997.

* cited by examiner

*Primary Examiner*—Necholus Ogden
(74) *Attorney, Agent, or Firm*—Pennie & Edmonds LLP

(57) ABSTRACT

A clear liquid detergent which contains, in water, liquid sodium silicate, an alkylethersulfate salt anionic surfactant, and a polyoxyethylene alkyl or aryl ether nonionic surfactant, and does not generate a precipitate or become cloudy due to a change in temperatures.

54 Claims, No Drawings

CLEAR LIQUID DETERGENT CONTAINING LIQUID SODIUM SILICATE AND SURFACTANTS IN WATER

TECHNICAL FIELD

The present invention relates to a novel detergent which contains liquid sodium silicate, and more specifically, to a clear liquid detergent containing liquid sodium silicate.

BACKGROUND ART

Liquid detergents utilizing sodium silicate which is liquid silicate salt have been expected to latently have a far excellent detergency power than those of any other surfactants, and since long time ago, there have been enormous efforts and researches made to develop such a detergent in many industrial fields including detergent and chemical industries. However, until today, there has been n6 developmental technique established in our country or other world industrial countries.

Conventionally, for liquid detergents, alminosilicate salts such as zeolites (A-type, Y-type), crystalline alminosilicate salts, inorganic silicates, inorganic carbonates or the like have been utilized as a detergency builder, and there have been a great number of patent applications filed. However, many of liquid cleansers, liquid detergents and the like are mainly designed for cleaning dishes, kitchen and bathroom, and liquid sodium silicate is not effectively utilized.

Liquid sodium silicate exhibits a mixing hindrance to a nonionic surfactant, an anionic surfactant, a metal-chelating agent, an anti-freezing agent, various builders, moisture and the like. When it is mixed with them, the mixture exhibits an optical anisotropy due to their reaction, becomes cloudy due to changes in temperature conditions caused by heating or warming, is gelled into a sherbet state due to an abrupt change in pH, and precipitates ultramicro-crystals. Therefore, the detergent containing liquid sodium silicate has not been easy to develop. In other words, there has been no clear liquid detergent which contains liquid sodium silicate together with a surfactant, and yet does not generate precipitates, or does not become cloudy due to the temperature changes.

Thus, it is an object of the present invention to provide a clear or transparent liquid detergent which contains liquid sodium silicate together with a surfactant and which does not generate precipitates, or does not become cloudy due to the temperature changes, such detergent being unable to be provided by the conventional technique.

DISCLOSURE OF INVENTION

The present inventors have conducted intensive researches for a long period of time in an attempt to provide a clear liquid detergent containing sodium silicate, that could not have been conventionally achieved, and at last accomplished the present invention.

Thus, the present invention provides a clear liquid detergent which contains, in water, liquid sodium silicate, an alkylethersulfate salt anionic surfactant, and a polyoxyethylene alkyl or aryl ether nonionic surfactant, and which does not generate precipitates or does not become cloudy due to a change in temperatures. Such a detergent has never existed in the past.

The present inventors have found that sodium silicate, a predetermined nonionic surfactant, a predetermined anionic surfactant, and optionally or preferably, a fluorosurfactant, form, preferably in the presence of a metal-chelatinqg agent, a buffering agent, a pH adjusting agent, and a freezing/clouding inhibitor, a liquid detergent which can be dissolved into water without a mutual inhibition reaction, fully exhibits a required detergency power, and maintains transparency without regard to temperature conditions. Based on these findings, the present invention has been accomplished.

In one aspect of the present invention, there is provides a clear liquid detergent composition containing liquid sodium silicate, an alkylethersulfate salt anionic surfactant, a polyoxyethylene alkyl or aryl ether nonionic surfactant, a metal-chelating agent, malic acid (particularly preferably DL-malic acid) or citric acid, glycerin, fatty acid alkanolamide and water, and optionally, further containing a fluorosurfactant.

Further, according: to the present invention, there is provided a clear liquid detergent composition comprising 10 to 35% by:weight of (a) a sodium silicate solution containing 1 to 40 parts by weight of sodium silicate, 30 to 85 parts by weight of water, 5 to 15 parts by weight of a metal-chelating agent, 0.1 to 3.0 parts by weight of malic acid (particularly preferably DL-malic acid) or citric acid and 0.15 to 15 parts by weight of glycerin; 89.5 to 59% by weight of either (b) a surfactant solution containing 5 to 50 parts by weight of an alkylethersulfate salt anionic surfactant, 5 to 30 parts by weight of a polyoxyethylene alkyl or aryl ether nonionic surfactant and 20 to 65 parts by weight of water, or (c) a surfactant solution containing 5 to 50 parts by weight of an alkylethersulfate salt anionic surfactant, 5 to 30 parts by weight of a polyoxyethylene alkyl or aryl ether nonionic surfactant, 0.01 to 0.1 part by weight of a fluorosurfactant and 20 to 65 parts by weight of water; and 0.5 to 6% by weight of (d) fatty acid alkanolamide.

The clear liquid detergent composition of the present invention is suitable for washing clothes, and cleaning niche, toilet, bathroom including a bath tub, and it can be used for cleaning dishes when diluted.

BEST MODE OF CARRYING OUT THE INVENTION

The present invention will now be described in more detail.

Liquid sodium silicate, which is contained characteristically in the clear liquid detergent (composition) of the present invention, imparts an excellent detergency power to the detergent, together with a predetermined surfactant, which will be explained later, and is an essential component for the detergent to function as such a detergent. The clear liquid detergent of the present invention, by containing liquid sodium silicate, exhibits such an excellent and high detergency power that cannot be achieved by a conventional detergent.

As such liquid sodium silicate described above, use may be made of sodium silicate No. 1 as specified by JIS (specific gravity: 59.2 or higher (Be value at 15° C.); silicon dioxide ($SiO_2$): 35 to 38% by weight; sodium oxide ($Na_2O$): 17 to 19% by weight, iron (Fe): 0.03% by weight or less,. and water-insoluble component: 0.2% by weight or less), sodium silicate No. 2 as specified by JIS (specific gravity: 54 or higher (Be at 15° C.); silicon dioxide ($SiO_2$): 34 to 36% by weight; sodium oxide ($Na_2O$): 14 to 15% by weight, iron (Fe): 0.03% by weight or less, and water-insoluble component: 0.2% or less by weight), and sodium silicate No. 3 as specified by JIS (specific gravity: 40 or higher (Be at 15° C.); silicon dioxide ($SiO_2$): 28 to 30% by weight; sodium oxide ($Na_2O$): 9 to 10% by weight, iron (Fe): 0.02% by weight, and water-insoluble component: 0.2% by weight or less). In general, sodium silicate used in the present invention can be represented also by formula: $Na_2O.nSiO_2$, and in the case where n=about 2 to 4, it is liquid. Apart from the JIS products or commercially available products, a prepared product obtained by mixing sodium oxide and silicon dioxide at a ratio of 1 mole of the former to 2 to 4 moles of the latter can be used. As liquid sodium silicate, JIS sodium silicate No. 2 and sodium silicate No. 3 are preferable, and in particular the silicate No. 2 is more preferable.

The surfactants used in the clear liquid detergent of the present invention are an alkylethersulfate salt anionic surfactant, a polyoxyethylene alkyl or aryl ether nonionic surfactant. Optionally, a fluorosurfactant can be further contained in the detergent of the present invention. As these surfactants, commercially available products can be used.

Preferable examples of the alkylethersulfate salt anionic surfactant are primary or secondary higher alcoholethoxysulfates and alkylphenolsulfates. Of these, primary and secondary alcoholethoxysulfates, each of which has an excellent detergency and an excellent foaming property, and is less irritative to skin, are particularly preferable.

Primary higher alcoholethoxysulfate can be represented by general formula:

$$R—(OCH_2CH_2)_nOSO_3M$$

where R represents a primary alkyl group, particularly, a $C_{12}$ alkyl group, M represents a cation, particularly an alkali metal such as sodium, and n represents 1 to 10. Secondary higher alcoholethoxysulfate can be represented by general formula:

$$R(R')—CH—(OCH_2CH_2)_nOSO_3M$$

where R represents an alkyl group, particularly, a $C_6$–$C_{10}$ alkyl group, R' represents an alkyl group, particularly, a $C_2$–$C_4$ alkyl group, M represents a cation, particularly an alkali metal such as sodium, and n represents 1 to 10.

Preferable examples of the polyoxyethylene alkyl or aryl ether nonionic surfactant are polyoxyethylene alkyl ethers (primary or secondary) and polyoxyethylene alkylphenyl ethers.

Polyoxyethylene alkyl ether can be represented by general formula:

$$RO(CH_2CH_2O)_nH$$

where R represents an alkyl group, preferably a $C_8$–$C_{18}$ alkyl group, particularly, a $C_{12}$ alkyl group, and n represents 7 to 10. Polyoxyethylene alkylphenyl ether can be represented by general formula:

$$R—C_6H_4—O(CH_2CH_2O)_nH$$

where R represents an alkyl group, preferably a $C_8$ to $C_9$ alkyl group, and n represents 9 to 12.

The fluorosurfactant, which is optionally or preferably mixed in the clear liquid detergent of the present invention, is a surfactant having a perfluorocarbon chain, and exhibits a very excellent surface activity at low concentrations. As the fluorosurfactant, an anionic type, nonionic type or ampholytic type can be used. Preferable examples of the fluorosurfactant are perfluoroalkylcarboxylic acid ($C_7$–$C_{13}$), perfluorooctanesulfonic acid diethanolamide, perfluoroalkyl ($C_4$–$C_{12}$) sulfonate salt (preferably, an alkali metal salt such as Li salt, K salt, Na salt or the like), N-propyl-N-(2-hydroxyethyl)perfluorooctanesulfonamide, perfluoroalkyl ($C_6$–$C_{10}$) sulfonamidopropyltrimethylammonium salt, perfluoroalkyl ($C_6$–$C_{10}$)-N-ethylsulfonylglycine salt (K salt or the like), monoperfluoroalkyl ($C_6$–$C_{10}$) ethylphosphoric acid ester, and the like. Of these, perfluoroalkylcarbonate ($C_7$–$C_{13}$) is particularly preferable.

In order to prepare a clear liquid detergent of the present invention, it is preferable to prepare in advance: (a) a mixture containing liquid sodium silicate, water, a metal-chelating agent, malic acid or citric acid and glycerin; and (b) a mixed surfactant solution containing an alkylethersulfate salt anionic surfactant, a polyoxyethylene alkyl or aryl ether nonionic surfactant, and water, or (c) a mixed surfactant solution containing an alkylethersulfate salt anionic surfactant, a polyoxyethylene alkyl or aryl ether nonionic surfactant, a fluorosurfactant and water. Then, to the mixed surfactant solution (b) or (c), the sodium silicate solution (a) is added gradually and mixed so as to suppress foaming, and to the obtained clear mixture, fatty acid alkanolamide as a freezing/clouding agent is added and mixed.

For the preparation of the sodium silicate solution (a), it is most preferable that water, a metal-chelating agent, and malic acid or citric acid be mixed and dissolved together, and to the resultant solution, liquid sodium silicate be added gradually and mixed, followed by the addition of glycerin.

The metal-chelating agent chelates the sodium silicate so as to capture it, thus stabilizing it. Preferable examples of the metal-chelating agent are ethylenediaminetetraacetic metal-chelating agent such as ethylenediaminetetraacetate (EDTA), tetrasodium ethylenediaminetetraacetate salt and disodium ethylenediaminetetraacetate salt, with tetrasodium ethylenediaminetetraacetate salt being particularly preferable.

Malic acid (particularly preferably, DL-malic acid) and citric acid serve to capture and stabilize the metal-chelating agent, especially an ethylenediaminetetraacetic metal-chelating agent. Malic acid and citric acid serve also as a pH adjusting agent.

Glycerin serves as a pH buffering agent, and both natural type and synthetic type can be used.

The freezing/clouding inhibitor inhibits the freezing of the clear liquid detergent of the present invention and to suppress the clouding thereof, and a fatty acid alkanolamide, which is a nonionic nitrogen-containing surfactant, is preferably used. Fatty acid alkanolamide is a condensation product of a fatty acid (preferably, $C_8$–$C_{18}$ fatty acid) such as capric acid, lauric acid, coconut oil fatty acid, myristic acid, stearic acid or oleic acid, and an alkanolamine (preferably, a $C_8$–$C_{18}$ alkanolamine) such as diethanolamine, monoethanolamine or isopropanol amine. Such fatty acid alkanolamides are commercially available.

The water used in the present invention may be any one of distilled water, purified water, ion exchanged soft water, regular tap water, ground water and the like.

In the sodium silicate solution (a), it is preferable that water be blended in an amount of 30 to 85 parts by weight. When the amount of water is less than 30 parts by weight, there is a tendency that the pH value decreases markedly, which is not preferable, whereas when it exceeds 85 parts by weight, there is a tendency that the pH value increases, which is not preferable. More preferably, water should be blended in an amount of 30 to 65 parts by weight. The metal-chelating agent should be blended preferably in an amount of 5 to 15 parts by weight. When the amount of the metal-chelating agent is less than 15 parts by weight, there is a tendency that the pH value increases, which is not preferable, whereas when it exceeds 15 parts by weight, there is a tendency that the pH value decreases, which is not preferable. More preferably, the metal-chelating agent should be blended in an amount of 5 to 12 parts by weight. Malic acid or citric acid should be blended preferably in an amount of 0.1 to 3.0 parts by weight. When the amount of malic acid or citric acid is less than 0.1 part by weight, the capturing ability for the metal-chelating agent cannot be exhibited, whereas when it is more than 0.3 parts by weight, the pH value decreases excessively, which is not preferable. More preferably, malic acid or citric acid should be blended in an amount of 0.1 to 2.0 parts by weight. Sodium silicate should be blended preferably in an amount of 1 to 40 parts by weight. When the amount of sodium silicate is less than 1 part by weight, the effect of sodium silicate cannot be fully exhibited, and the detergency effect is reduced, which is not preferable, whereas when it exceeds 40 parts by weight, alkali becomes excessive, which is not preferable. More preferably, sodium silicate should be blended in an amount of 1 to 35 parts by weight. Glycerin should be blended preferably in an amount of 0.5 to 15 parts by weight. When the amount of glycerin is less than 0.5, the buffering ability is decreased, which is not preferable, whereas when it exceeds 15 parts by weight, the viscosity increases, which is not preferable. More preferably, glycerin should be blended in an amount of 1 to 12 parts by weight.

In the mixed surfactant solution (b) or (c), the polyoxyethylene alkyl or aryl ether nonionic surfactant should preferably be blended in an amount of 5 to 30 parts by weight. When the amount of the nonionic surfactant is less than 5 parts by weight, the detergency effect decreases, which is not preferable, whereas when it exceeds 30 parts by weight, the detergency effect reaches,an equilibrium state or excessive foaming is generated, which is not preferable. It is more preferable that the polyoxyethylene alkyl or aryl ether nonionic surfactant be blended in an amount of 5 to 25 parts by weight. The alkylethersulfate salt anionic surfactant should be blended preferably in an amount of 5 to 50 parts by weight. When the amount of the anionic surfactant is less than 5 parts by weight, the detergency effect decreases, which is not preferable, whereas when it. exceeds 50 parts by weight, the cleaning detergency effect reaches an equilibrium state or excessive foaming is generated, which is not preferable. It is more preferable that the alkylethersulfate salt anionic surfactant be blended in an amount of 5 to 40 parts by weight.

In the aqueous solution (c) of the mixed surfactant, the fluorosurfactant should be blended preferably in an amount of 0.01 to 0.1 part by weight. If the amount of the fluorosurfactant is less than 0.01 part by weight, the detergency effect is reduced, which is not preferable. On the other hand, if it exceeds 0.1 part by weight, excessive foaming occurs, which is not preferable. It is more preferable that the fluorosurfactant be blended in an amount of about 0.01 to about 0.08 parts by weight.

The clear liquid detergent of the present invention can be obtained by adding the above sodium silicate solution (a) to the mixed surfactant solution (b) or (c), and mixing fatty acid alkanolamide to thus obtained clear mixture. Here, it is most preferable to blend the sodium silicate solution (a) in an amount of 10 to 35% by weight, the mixed surfactant solution (b) or (c) in an amount of 89.5 to 59% by weight, and fatty acid alkanolamide in an amount of 0.5 to 6% by weight. When the amount of fatty acid alkanolamide is less than 0.5% by weight, no effect results, whereas when it exceeds 6% by weight, the viscosity increases abruptly, which is not preferable. It is more preferable that fatty acid alkanolamide be blended in an amount of 1 to 4% by weight.

It is most preferable that the clear liquid detergent of the present invention contain liquid sodium silicate in an amount of 4.5 to 13.2% by weight.

The sodium silicate-containing clear liquid detergent, thus obtained, maintains its transparency of a so-called crystal-clear type, that it does not generate a deposit or precipitate (precipitates such as silica deposited from sodium silicate, and sodium sulfate by the reaction between the surfactant and the alkali) under the usual use conditions and does not create cloudiness even the temperature varies. Further, in terms of detergency power, it is far superior to the conventional detergent. As described, the clear liquid detergent composition of the present invention exhibits an excellent detergency power in washing of clothes, and cleaning of a washing niche, toilet, bathroom including a bath tub. Further, when diluted with water, the detergent exhibits an excellent power for cleaning dishes. For example, in the case where the clear liquid detergent of the present invention is used for washing clothes, it is preferable that the detergent of the present invention be dissolved at a ratio of 0.8 to 1.0 g per IL (liter) of water.

The present invention will now be described with reference to EXAMPLES.

EXAMPLE 1

Preparation of the Sodium Silicate Solution (a)

52.4 parts by weight of tap water, 6 parts by weight of tetrasodium ethylenediaminetetraacetate salt and 0.6 parts by weight of DL-malic acid were mixed together to make a solution, then 33 parts by weight of sodium silicate No. 2 as specified by JIS was gradually added thereto while stirring. Subsequently, 8 parts by weight of glycerin was added while stirring, and then the mixture was sufficiently stirred. Thus, an aqueous solution (a) of sodium silicate was prepared.

Preparation of the Mixed Surfactant Solution (b)

16 parts by weight of a polyoxyethylene alkyl ether nonionic surfactant (PERESOFT 209 of Miyoshi Oil & Fat Co., Ltd.: primary higher alcohol ethoxylate), 28 parts by weight of an alkylethersulfate salt anionic surfactant (SPAMINE C25 of Miyoshi Oil & Fat Co., Ltd.: primary higher alcohol ethoxysulfate), and 56 parts by weight of tap water were fully mixed together, and thus a mixed surfactant solution (b) was prepared.

Preparation of Detergent

To the mixed surfactant solution (b), the above-described sodium silicate aqueous solution was added while gently stirring the solution (b) so as to suppress foaming in the-stirring tub. To thus obtained mixture, fatty acid alkanolamide (STARFOAM-F of Lion Oil & Fat Co., Ltd.: condensation product of coconut fatty acid and diethanolamine) was added and mixed. Thus, a total of five types of detergents (Detergents A to F) were obtained. The blending amounts (% by weight) of the sodium silicate aqueous solution (a), the mixed surfactant solution (b) and fatty acid alkanolamide are indicated in Table 1.

EXAMPLE 2

Preparation of the Sodium Silicate Solution (a)

52.4 parts by weight of tap water, 6 parts by weight of tetra-Na ethylenediaminetetraacetate and 0.6 parts by weight of citric acid were mixed together to make a solution, then 33 parts, by weight of sodium silicate No. 3 as specified by JIS was gradually added thereto while stirring. Subsequently, 8 parts by weight of glycerin was added while stirring, and then the mixture was sufficiently stirred. Thus, an aqueous solution (a) of sodium silicate was prepared.

Preparation of the Mixed Surfactant Solution (c)

27.9 parts by weight of a sulfate ester type alkylethersulfate salt anionic surfactant (SPAMINE C-25 of Miyoshi Oil & Fat Co., Ltd.) which is an anionic surfactant, 16 parts by weight of a polyoxyethylene alkyl ether nonionic surfactant (PERESOFT 209 of Miyoshi Oil & Fat Co., Ltd.), 0.1 part by weight of a fluorosurfactant (SURFLON S-111 (water-soluble) of Asahi Glass Co., Ltd.: perfluoro $C_8$ alkylcarboxylic acid), and 56 parts by weight of tap water were fully mixed together, and thus a mixed surfactant solution (c) was prepared.

Preparation of Detergent

To the mixed surfactant solution (c), the sodium silicate solution was added-while gently stirring the solution (c) so as to suppress foaming in the stirring tub. To thus obtained uniform mixture, fatty acid alkanolamide (STARFOAM-F of Lion Oil & Fat Co., Ltd.), was added and mixed. Thus, a total of four types of detergents (Detergents F to I) were obtained. The blending amounts (% by weight) of the sodium silicate aqueous solution (a), the mixed surfactant solution (b) and fatty acid alkanolamide are indicated in Table 2.

It should be noted that Tables 1 and 2 indicate the amount of each component to the entirety (in % by weight) of the detergents A to I, together with the pH value and the pH value measured in accordance with JIS K3362-6.3 (that is, pH value obtained when diluted with water by 1000-fold: in Tables 1 and 2, it is indicated as a 1000-fold diluted pH value). The pH measurement was carried out by using HM-202, a glass electrode pH meter of TOA DENPA Ltd. at a temperature of 15° C.

TABLE 1

| Components | | Detergent (% by weight) A | B | C | D | E |
|---|---|---|---|---|---|---|
| Sodium silicate aqueous solution | | 20.0 | 25.0 | 30.0 | 35.0 | 40.0 |
| Mixed surfactant solution | | 78.0 | 73.0 | 68.0 | 63 | 58.0 |
| Fatty acid alkanolamide | | 2.0 | 2.0 | 2.0 | 2.0 | 2.0 |
| Proportion in detergent in entirety | Tertasodium ethylendiaminetetra-acetate salt | 1.2 | 1.5 | 1.8 | 2.1 | 2.4 |
| | DL-malic acid | 0.12 | 0.15 | 0.18 | 0.21 | 0.4 |
| | Citric acid | — | — | — | — | — |
| | Sodium silicate No. 2 | 6.6 | 8.25 | 9.9 | 11.5 | 13.2 |
| | Sodium silicate No. 3 | — | — | — | — | — |
| | Glycerin | 1.6 | 2.0 | 2.4 | 2.8 | 3.2 |
| | Polyoxyethylene alkyl-ether surfactant | 12.48 | 11.68 | 10.88 | 10.08 | 9.28 |
| | Alkylether sulfate surfactant | 21.84 | 20.44 | 19.04 | 17.64 | 16.24 |
| | Fluorosurfactant | — | — | — | — | — |
| | Fatty acid alkanolamide | 2.0 | 2.0 | 2.0 | 2.0 | 2.0 |
| | Water (total) | 54.16 | 53.98 | 53.80 | 53.62 | 53.44 |
| pH value | | 11.54 | 11.61 | 11.67 | 11.72 | 12.07 |
| 1000-fold diluted pH value | | 7.65 | 7.75 | 8.33 | 8.36 | 8.50 |

TABLE 2

| Components | | Detergent (% by weight) F | G | H | I |
|---|---|---|---|---|---|
| Sodium silicate aqueous solution | | 15.0 | 20.0 | 25.0 | 30.0 |
| Mixed surfactant solution | | 83.0 | 78.0 | 73.0 | 68.0 |
| Fatty acid alkanolamide | | 2.0 | 2.0 | 2.0 | 2.0 |

TABLE 2-continued

| Components | | Detergent (% by weight) F | G | H | I |
|---|---|---|---|---|---|
| Proportion in detergent in entirety | Tertasodium ethylendiaminetetra-acetate salt | 0.9 | 1.2 | 1.5 | 1.8 |
| | DL-malic acid | — | — | — | — |
| | Citric acid | 0.09 | 0.12 | 0.15 | 0.18 |
| | Sodium silicate No. 2 | — | — | — | — |
| | Sodium silicate No. 3 | 4.95 | 6.6 | 8.25 | 9.9 |
| | Glycerin | 1.2 | 1.6 | 2.0 | 2.4 |
| | Polyoxyethylene alkyl-ether surfactant | 13.28 | 12.48 | 11.68 | 10.88 |
| | Alkylether sulfate surfactant | 23.157 | 21.762 | 20.367 | 18.972 |
| | Fluorosurfactant | 0.083 | 0.078 | 0.073 | 0.068 |
| | Fatty acid alkanolamide | 2.0 | 2.0 | 2.0 | 2.0 |
| | Water (total) | 54.34 | 54.16 | 53.98 | 53.80 |
| pH value | | 11.57 | 11.68 | 11.74 | 11.81 |
| 1000-fold diluted pH value | | 7.36 | 7.75 | 7.88 | 8.42 |

The detergents prepared as above were measured in terms of transparency, stability, cloudiness and viscosity in the below-described manner.

Transparency 200 mL (milliliter) of each of the detergents was placed in a respective clear glass container having a diameter of 60 mm, and it was evaluated as to whether or not letters in a normal-size Japanese to English dictionary can be identified through the liquid detergent, on the basis of the following standards:

○: letters can be clearly read

Δ: they can be read, but with some difficulty

X: they cannot at all be read

Cloudiness 200 mL of each of the detergents was placed in a respective glass container with a stopper, having a diameter of 60 mm, and the cloudiness created by silica precipitated from the sodium silicate in each detergent, the cloudiness caused by:the alkali reaction of the surfactants, and the cloudiness due to the optical anisotropy caused by a change in temperatures were evaluated by eye on the basis of the following standards.

○=No cloudiness at all

Δ=A little cloudy

X=Cloudy

Stability 200 mL-glass containers were filled with the detergents, and they were air-tightly stoppered. After preserved for one month at 35° C., the stability was evaluated on the basis of the following standards.

○=Separation and precipitation of sodium silicate was not observed

Δ=Separation and precipitation of sodium silicate was observed in small amount

X=Separation and precipitation of sodium silicate was observed

Viscosity

The detergents were measured in terms of viscosity using a C-type viscosity meter of TOKYO KEIKI (Co., Ltd.) at 20° C.

The results for the above are indicated in Tables 3 and 4 below.

TABLE 3

| Evaluation items | Detergents A | B | C | D | E |
|---|---|---|---|---|---|
| Transparency | Δ | ○ | ○ | ○ | ○ |
| Cloudiness | ○ | ○ | ○ | ○ | ○ |
| Stability | ○ | ○ | ○ | ○ | ○ |
| Viscosity (cP) | 235.5 | 215.0 | 220.0 | 190.0 | 165.0 |

TABLE 4

| Evaluation items | Detergents F | G | H | I |
|---|---|---|---|---|
| Transparency | ○ | ○ | ○ | ○ |
| Cloudiness | ○ | ○ | ○ | ○ |
| Stability | ○ | ○ | ○ | ○ |
| Viscosity (cP) | 240.0 | 225.0 | 210.0 | 160.0 |

Next, of the liquid detergents A to I of the present invention, the liquid detergents B, C, G and H were examined to evaluate the detergency power. The evaluation of the detergency power was made by the method of evaluating a synthetic detergent for clothes defined in JIS K3362-1990, 7.1.

a) Preparation of Dirty collar cloth

An Indian cotton white cloth was cut into a size of 11×13 cm, and two cut cloth pieces were sewed together to match the short and long sides in the same texture pattern direction with a seam allowance of 1 cm. Thus, a collar cloth (11×24 cm) was made. A many number of such cloth pieces were prepared.

The collar cloth pieces were stitched onto the collars of work clothes, and the work clothes were worn by workers, who work under ordinary working conditions for 2 to 7 days, thus preparing dirty collar clothes.

Of the dirty collar clothes, those which became dirty uniformly to the left and right of the seam line were selected, and they were divided into three levels, that is, very dirty, fairly dirty and little dirty, in accordance with the degree of the dirtiness. 5 of dirty collar clothes were prepared for each level, and therefore a total of 15 clothes were prepared. Then, the thread sewing the seaming allowance portion of each dirty collar cloth was removed, to separate it into two, which were to be used for test. Before the thread on the sewing allowance portion is removed from each dirty collar cloth, symbols which indicate that dirty collar clothes are of a symmetrical pair (for example, No. 1 and No. 1') were marked on both corners of the cloth with an oil marking pen.

In the manner described as above, 8 sets each consisting of 15 test cloth pieces were prepared.

b) Preparation of Detergency Power Determining Test Solution

1. Reference Detergent for Determining Cleaning Power

Sodium linear dodecylbenzenesulfonate, sodium tripolyphosphate, sodium silicate, sodium carbonate, sodium carboxymethylcellulose and sodium sulfate, each of which were prescribed, were mixed at a weight ratio of 15:17:10:3:1:58, and dried at about 105° C., then made into powder. 1.33 g of the powder, in terms of the amount of anhydride, was weighed out and dissolved into 1000 mL of the prescribed use water (obtained by dissolving 133 mg of potassium chloride dihydrate to water to make a total amount of 1000 mL).

There were prepared four of such a reference detergent solution.

2. Each of the liquid detergents B, C, G and H of EXAMPLES 1 to 4 was dissolved into 1000 mL of prescribed use water at 1 g/L.

c) Operation (1) Into 1L of each of the reference detergent solutions for determining the detergency power and the cleaning aqueous solutions of EXAMPLES 1 to 4 (at 30° C.), one set of dirty collar cloth (15 pieces) prepared as test cloth was put. Meanwhile, one set of dirty collar cloth (15 pieces) which make pairs with the above, was put into 1L of each of the reference detergent solutions. The dirty collar cloth was washed in each detergent solution for 10 minutes using a detergency power testing machine of the prescribed mixing mode (rotation number 120±5 rotations per minute).

(2) After finishing the washing, each sample cloth was squeezed softly and put into 1L of the prescribed use water of 30° C., so as to be rinsed for 30 minutes, using the mixing type detergency power testing machine noted above. This operation was repeated two times.

(3) After finishing the rinsing, each test cloth was air-dried, and a test cloth cleaned with the reference detergent solution and a corresponding test cloth cleaned with a detergent solution of a respective one of EXAMPLES 1 to 4, were stitched together into a pair, followed by ironing. In this manner, test samples of 15×4 were prepared in total.

d) Evaluation 15 pairs of test sample cloth pieces were placed in the order of marked symbols, and the degree of removing of the dirt on a sample cloth cleaned with the detergent solution of the present invention, as compared to the test cloth of each pair, which was cleaned with the reference detergent solution, was evaluated by three panelists on the basis of the following standard while they compared the test cloth pieces on the left and right sides, of each pair with each other.

−2: clearly inferior

−1: somewhat inferior

0: not substantially different

+1: somewhat superior

+2: clearly superior

The results were indicated in Tables 5 to 8.

TABLE 5

| Dirty collar cloth No. | (Detergent B) Panelist 1 | Panelist 2 | Panelist 3 |
|---|---|---|---|
| 1 | +2 | +2 | +2 |
| 2 | +1 | +1 | +1 |
| 3 | +2 | +2 | +2 |
| 4 | +1 | +1 | +1 |
| 5 | +1 | +1 | +1 |
| 6 | +2 | +2 | +2 |
| 7 | +2 | +2 | +2 |
| 8 | +2 | +2 | +2 |
| 9 | +1 | +1 | +2 |
| 10 | +1 | +1 | +1 |
| 11 | +2 | +2 | +2 |
| 12 | +1 | +2 | +2 |
| 13 | +2 | +2 | +2 |
| 14 | +2 | +2 | +1 |
| 15 | +2 | +2 | +2 |
| Total | +24 | +25 | +25 |

TABLE 6

(Detergent C)

| Dirty collar cloth No. | Panelist 1 | Panelist 2 | Panelist 3 |
|---|---|---|---|
| 1 | +2 | +2 | +2 |
| 2 | +2 | +2 | +2 |
| 3 | +1 | +2 | +2 |
| 4 | +2 | +2 | +2 |
| 5 | +2 | +2 | +2 |
| 6 | +1 | +2 | +2 |
| 7 | +2 | +1 | +1 |
| 8 | +1 | +2 | +2 |
| 9 | +2 | +1 | +1 |
| 10 | +2 | +2 | +2 |
| 11 | +1 | +2 | +2 |
| 12 | +2 | +2 | +2 |
| 13 | +2 | +2 | +2 |
| 14 | +2 | +1 | +1 |
| 15 | +2 | +2 | +2 |
| Total | +26 | +27 | +27 |

TABLE 7

(Detergent G)

| Dirty collar cloth No. | Panelist 1 | Panelist 2 | Panelist 3 |
|---|---|---|---|
| 1 | +2 | +2 | +2 |
| 2 | +2 | +2 | +2 |
| 3 | +2 | +2 | +2 |
| 4 | +2 | +2 | +2 |
| 5 | +2 | +2 | +2 |
| 6 | +2 | +2 | +2 |
| 7 | +2 | +2 | +2 |
| 8 | +2 | +2 | +2 |
| 9 | +2 | +2 | +2 |
| 10 | +2 | +2 | +2 |
| 11 | +2 | +2 | +2 |
| 12 | +2 | +2 | +2 |
| 13 | +1 | +2 | +2 |
| 14 | +2 | +2 | +2 |
| 15 | +2 | +2 | +2 |
| Total | +29 | +30 | +30 |

TABLE 8

(Detergent H)

| Dirty collar cloth No. | Panelist 1 | Panelist 2 | Panelist 3 |
|---|---|---|---|
| 1 | +2 | +2 | +2 |
| 2 | +2 | +2 | +2 |
| 3 | +2 | +2 | +2 |
| 4 | +2 | +2 | +2 |
| 5 | +2 | +2 | +2 |
| 6 | +2 | +2 | +2 |
| 7 | +2 | +2 | +2 |
| 8 | +2 | +2 | +2 |
| 9 | +2 | +2 | +2 |
| 10 | +2 | +2 | +2 |
| 11 | +2 | +2 | +2 |
| 12 | +2 | +2 | +2 |
| 13 | +2 | +2 | +2 |

TABLE 8-continued (Detergent H)

| Dirty collar cloth No. | Panelist 1 | Panelist 2 | Panelist 3 |
|---|---|---|---|
| 14 | +2 | +2 | +2 |
| 15 | +2 | +2 | +2 |
| Total | +30 | +30 | +30 |

As described above, according to the present invention, there can be provided, for the first time, a clear liquid detergent containing sodium silicate and a surfactant, which has been considered difficult or impossible to obtain until today. The sodium silicate-containing clear liquid detergent of the present invention is stable for a long period of time, does not create precipitates or cloudiness, and has a very excellent detergency power.

What is claimed is:

1. A clear liquid detergent consisting of:

liquid sodium silicate; a metal-chelating agent; malic acid or citric acid; glycerin; an alkylethersulfate salt anionic surfactant; a polyoxyethylene alkyl or aryl ether non-ionic surfactant; a fatty acid alkanolamide; water; and optionally a fluorosurfactant.

2. The clear liquid detergent according to claim 1, which contains no fluorosurfactant.

3. The clear liquid detergent according to claim 1, which contains said fluorosurfactant.

4. The clear liquid detergent according to claim 1, which contains the liquid sodium silicate in an amount of from 4.5% to 13.2% by weight.

5. The clear liquid detergent according to claim 1, wherein said alkylethersulfate salt anionic surfactant comprises an alcholethoxysulfate represented by a formula:

$$R—(OCH_2CH_2)_nOSO_3M$$

where R represents a primary alkyl group, M represents a cation, and n represents 1 to 10.

6. The clear liquid detergent according to claim 5, wherein said R represents a primary alkyl group having 12 carbon atoms.

7. The clear liquid detergent according to claim 5, wherein said M represents an alkali metal cation.

8. The clear liquid detergent according to claim 1, wherein said alkylethersulfate salt anionic surfactant comprises an alcholethoxysulfate represented by a formula:

$$R(R')—CH—(OCH_2CH_2)_nOSO_3M$$

where R represents an alkyl group, R' represents an alkyl group, M represents a cation, and n represents 1 to 10.

9. The clear liquid detergent according to claim 8, wherein said R represents an alkyl group having from 6 to 10 carbon atoms, said R' represents an alkyl group having from 2 to 4 carbon atoms, and said M represents an alkali metal cation.

10. The clear liquid detergent according to claim 1, wherein said polyoxyethylene alkyl ether is represented by a formula:

$$RO(CH_2CH_2O)_nH$$

where R represents an alkyl group, and n represents 7 to 10.

11. The clear liquid detergent according to claim 10, wherein said R represents an alkyl group having from 8 to 18 carbon atoms.

12. The clear liquid detergent according to claim 1, wherein said polyoxyethylene alkylphenyl ether is represented by a formula:

$$R—C_6H_4—O(CH_2CH_2O)_nH$$

where R represents an alkyl group, and n represents 9 to 12.

13. The clear liquid detergent according to claim 12, wherein said R represents an alkyl group having 8 or 9 carbon atoms.

14. The clear liquid detergent according to claim 3, wherein said fluorosurfactant comprises a perfluoroaklylcarbonate.

15. The clear liquid detergent according to claim 1, wherein said metal-chelating agent comprises a substance selected from the group consisting of ethylenediaminetetraacetate, tetrasodium ethylenediaminetetraacetate and disodium ethylenediaminetetraacetate.

16. The clear liquid detergent according to claim 1, wherein said fatty acid alkanolamide is a condensation product of a fatty acid having from 8 to 18 carbon atoms with an alkanolamine having from 8 to 18 carbon atoms.

17. A clear liquid detergent consisting of:

liquid sodium silicate; a metal-chelating agent; malic acid or citric acid; glycerin; an alkylethersulfate salt anionic surfactant; a polyoxyethylene alkyl or aryl ether nonionic surfactant; a fatty acid alkanolamide; and water; wherein said detergent being essentially formed of a mixture of:

10 to 35% by weight of (a) a sodium silicate solution containing 1 to 40 parts by weight of liquid sodium silicate, 30 to 85 parts by weight of water, 5 to 15 parts by weight of a metal-chelating agent, 0.1 to 3 parts by weight of malic acid or citric acid and 0.15 to 15 parts by weight of glycerin;

89.5 to 59% by weight of (b) a surfactant solution containing 5 to 50 parts by weight of an alkylethersulfate salt anionic surfactant, 5 to 30 parts by weight of a polyoxyethylene alkyl or aryl ether noninonic surfactant and 20 to 65 parts by weight of water; and 0.5 to 6% by weight of (d) a fatty acid alkanolamide.

18. The clear liquid detergent according to claim 17, which contains the liquid sodium silicate in an amount of 4.5% to 13.2% by weight.

19. The clear liquid detergent according to claim 17, wherein said alkylethersulfate salt anionic surfactant comprises an alcholethoxysulfate represented by a formula:

$$R—(OCH_2CH_2)_nOSO_3M$$

where R represents a primary alkyl group, M represents a cation, and n represents 1 to 10.

20. The clear liquid detergent according to claim 19, wherein said R represents a primary alkyl group having 12 carbon atoms.

21. The clear liquid detergent according to claim 19, wherein said M represents an alkali metal cation.

22. The clear liquid detergent according to claim 17, wherein said alkylethersulfate salt anionic surfactant comprises an alcholethoxysulfate represented by a formula:

$$R(R')—CH—(OCH_2CH_2)_nOSO_3M$$

where R represents an alkyl group, R' represents an alkyl group, M represents a cation, and n represents 1 to 10.

23. The clear liquid detergent according to claim 22, wherein said R represents an alkyl group having from 6 to 10 carbon atoms, said R' represents an alkyl group having from 2 to 4 carbon atoms, and said M represents an alkali metal cation.

24. The clear liquid detergent according to claim 17, wherein said polyoxyethylene alkyl ether is represented by a formula:

$$RO(CH_2CH_2O)_nH$$

where R represents an alkyl group, and n represents 7 to 10.

25. The clear liquid detergent according to claim 24, wherein said R represents an alkyl group having from 8 to 18 carbon atoms.

26. The clear liquid detergent according to claim 17, wherein said polyoxyethylene alkylphenyl ether is represented by a formula:

$$R—C_6H_4—O(CH_2CH_2O)_nH$$

where R represents an alkyl group, and n represents 9 to 12.

27. The clear liquid detergent according to claim 26, wherein said R represents an alkyl group having 8 or 9 carbon atoms.

28. The clear liquid detergent according to claim 17, wherein said metal-chelating agent comprises a substance selected from the group consisting of ethylenediaminetetraacetate, tetrasodium ethylenediaminetetraacetate and disodium ethylenediaminetetraacetate.

29. The clear liquid detergent according to claim 17, wherein said fatty acid alkanolamide is a condensation product of a fatty acid having from 8 to 18 carbon atoms with an alkanolamine having from 8 to 18 carbon atoms.

30. The clear liquid detergent according to claim 17, wherein said sodium silicate solution (a) contains from 1 to 35 parts by weight of liquid sodium silicate, from 30 to 65 parts by weight of water, 5 to 12 parts by weight of metal-chelating agent, 0.1 to 2 parts by weight of malic acid or citric acid, and 1 to 12 parts by weight of glycerin.

31. The clear liquid detergent according to claim 30, wherein said surfactant solution (b) contains 5 to 40 parts by weight of alkylethersulfate salt anionic surfactant, and 5 to 25 parts by weight of polyoxyethylene alkyl or aryl ether nonionic surfactant.

32. The clear liquid detergent according to claim 31, wherein said mixture contains 1 to 4% by weight of fatty acid aklanolamide.

33. The clear liquid detergent according to claim 32, which contains the liquid sodium silicate in an amount of 4.5 to 13.2% by weight.

34. A clear liquid detergent consisting of:

liquid sodium silicate; a metal-chelating agent; malic acid or citric acid; glycerin; an alkylethersulfate salt anionic surfactant; a polyoxyethylene alkyl or aryl ether nonionic surfactant; a fatty acid alkanolamide; and flurosurfactant and water; wherein said detergent being essentially formed of a mixture of:

10 to 35% by weight of (a) a sodium silicate solution containing 1 to 40 parts by weight of liquid sodium silicate, 30 to 85 parts by weight of water, 5 to 15 parts by weight of a metal-chelating agent, 0.1 to 3 parts by weight of malic acid or citric acid and 0.15 to 15 parts by weight of glycerin;

89.5 to 59% by weight of (c) a surfactant solution containing 5 to 50 parts by weight of an alkylethersulfate salt anionic surfactant, 5 to 30 parts by weight of a polyoxyethylene alkyl or aryl ether noninonic surfactant, 0.01 to 0.1 parts by weight of flurosurfactant and 20 to 65 parts by weight of water; and 0.5 to 6% by weight of (d) a fatty acid alkanolamide.

35. The clear liquid detergent according to claim 34, which contains the liquid sodium silicate in an amount of 4.5 to 13.2% by weight.

36. The clear liquid detergent according to claim 34, wherein said alkylethersulfate salt anionic surfactant comprises an alcholethoxysulfate represented by a formula:

$$R—(OCH_2CH_2)_nOSO_3M$$

where R represents a primary alkyl group, M represents a cation, and n represents 1 to 10.

37. The clear liquid detergent according to claim 36, wherein said R represents an alkyl group having 12 carbon atoms.

38. The clear liquid detergent according to claim 36, wherein said M represents an alkali metal cation.

39. The clear liquid detergent according to claim 34, wherein said alkylethersulfate salt anionic surfactant comprises an alcholethoxysulfate represented by a formula:

$$R(R')—CH—(OCH_2CH_2)_nOSO_3M$$

where R represents an alkyl group, R' represents an alkyl group, M represents a cation, and n represents 1 to 10.

40. The clear liquid detergent according to claim 39, wherein said R represents an alkyl group having from 6 to 10 carbon atoms, said R' represents an alkyl group having from 2 to 4 carbon atoms, and said M represents an alkali metal cation.

41. The clear liquid detergent according to claim 34, wherein said polyoxyethylene alkyl ether is represented by a formula:

$$RO(CH_2CH_2O)_nH$$

where R represents an alkyl group, and n represents 7 to 10.

42. The clear liquid detergent according to claim 41, wherein said R represents an alkyl group having from 8 to 18 carbon atoms.

43. The clear liquid detergent according to claim 34, wherein said polyoxyethylene alkylphenyl ether is represented by a formula:

$$R—C_6H_4—O(CH_2CH_2O)_nH$$

where R represents an alkyl group, and n represents 9 to 12.

44. The clear liquid detergent according to claim 43, wherein said R represents an alkyl group having 8 or 9 carbon atoms.

45. The clear liquid detergent according to claim 34, wherein said metal-chelating agent comprises a substance selected from the group consisting of ethylenediaminetetraacetate, tetrasodium ethylenediaminetetraacetate and disodium ethylenediaminetetraacetate.

46. The clear liquid detergent according to claim 34, wherein said fatty acid alkanolamide is a condensation product of a fatty acid having from 8 to 18 carbon atoms with an alkanolamine having from 8 to 18 carbon atoms.

47. The clear liquid detergent according to claim 34, wherein said fluorosurfactant comprises a perfluoroalkylcarbonate.

48. The clear liquid detergent according to claim 34, wherein said sodium silicate solution (a) contains from 1 to 35 parts by weight of liquid sodium silicate, from 30 to 65 parts by weight of water, 5 to 12 parts by weight of metal-chelating agent, 0.1 to 2 parts by weight of malic acid or citric acid, and 1 to 12 parts by weight of glycerin.

49. The clear liquid detergent according to claim 48, wherein said surfactant solution (c) contains 5 to 40 parts by weight of alkylethersulfate salt anionic surfactant, 5 to 25 parts by weight of polyoxyethylene alkyl or aryl ether nonionic surfactant, and 0.01 to 0.08 parts by weight of fluorosurfactant.

50. The clear liquid detergent according to claim 49, wherein said mixture contains 1 to 4% by weight of fatty acid aklanolamide.

51. The clear liquid detergent according to claim 50, which contains the liquid sodium silicate in an amount of 4.5 to 13.2% by weight.

52. The clear liquid detergent according to claim 1, which is diluted with water at a ratio of 0.8 to 1.0 g of the detergent per liter of water.

53. The clear liquid detergent according to claim 17, which is diluted with water at a ratio of 0.8 to 1.0 g of the detergent per liter of water.

54. The clear liquid detergent according to claim 34, which is diluted with water at a ratio of 0.8 to 1.0 g of the detergent per liter of water.

* * * * *